US006767452B1

(12) United States Patent
Siskin et al.

(10) Patent No.: US 6,767,452 B1
(45) **Date of Patent: *Jul. 27, 2004**

(54) PROCESS FOR TREATMENT OF PETROLEUM ACIDS

(75) Inventors: Michael Siskin, Randolph, NJ (US); Pacifico Viernes Manalastas, Edison, NJ (US); Guido Sartori, Milan (IT)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/958,436

(22) PCT Filed: May 9, 2000

(86) PCT No.: PCT/US00/12834

§ 371 (c)(1),
(2), (4) Date: Oct. 9, 2001

(87) PCT Pub. No.: WO00/68341

PCT Pub. Date: Nov. 16, 2000

Related U.S. Application Data

(63) Continuation-in-part of application No. 09/309,941, filed on May 11, 1999, now Pat. No. 6,190,541.

(51) Int. Cl.[7] ..... C10G 45/00
(52) U.S. Cl. ..... 208/263; 208/47; 208/230
(58) Field of Search ..... 208/230, 47, 263

(56) References Cited

U.S. PATENT DOCUMENTS

| | | | | |
|---|---|---|---|---|
| 2,028,335 A | | 1/1936 | Kalichevsky | 196/32 |
| 2,068,979 A | | 1/1937 | Fisher | 196/35 |
| 2,152,723 A | * | 4/1939 | Yabroff | 208/232 |
| 2,302,281 A | | 11/1942 | Watkins | 252/50 |
| 2,770,580 A | | 11/1956 | Honeycutt et al. | 196/36 |
| 2,795,532 A | | 6/1957 | Honeycutt | 196/36 |
| 2,911,360 A | * | 11/1959 | Myers | 208/263 |
| 4,199,440 A | | 4/1980 | Verachtert | 208/230 |
| 4,300,995 A | | 11/1981 | Liotta | 208/8 |
| 5,169,598 A | | 12/1992 | Zetlmeisl et al. | 422/16 |
| 5,643,439 A | | 7/1997 | Sartori et al. | 208/47 |
| 5,683,626 A | | 11/1997 | Sartori et al. | 252/389.62 |
| 6,190,541 B1 | * | 2/2001 | Siskin et al. | 208/263 |

FOREIGN PATENT DOCUMENTS

| | | | |
|---|---|---|---|
| DE | 4131406 C1 | 3/1993 | C10G/19/00 |
| WO | WO 94/10268 | 5/1994 | C10M/129/06 |
| WO | WO97/08270 | 3/1997 | C10G/19/00 |
| WO | WO9708271 | 6/1997 | C10G/19/00 |
| WO | WO9708275 | 6/1997 | C10G/71/00 |
| WO | WO00/20532 | 4/2000 | C10G/29/22 |
| WO | WO00/20533 | 4/2000 | C10G/29/22 |

OTHER PUBLICATIONS

Kalichevsky, Petroleum Refining With Chemicals (1956).
Camp, Neutralization as a Means of Controlling Corrosion of Refinery Equipment National Association of Corrosion Engineers (Feb. 1950).
Streitwieser, Introduction of Organic Chemistry — Second Edition, pp. 516–518 (1981).
Abstract, Derwent Publications Ltd., AN 2000–318773, XP002231593 & CN 1 245 160 A (China Petro Chem Corp.), Feb. 23, 2000.

* cited by examiner

*Primary Examiner*—Walter D. Griffin
*Assistant Examiner*—James Arnold, Jr.
(74) *Attorney, Agent, or Firm*—Linda M. Scuorzo

(57) ABSTRACT

The invention is a process for decreasing the acidity of an organic acid containing petroleum oil, comprising contacting said petroleum oil containing organic acids with an effective amount of an alcohol and an effective trace amount of a base selected from Group IA and IIA metal carbonates, hydroxides, phosphates, biphosphates and mixtures of a hydroxide and phosphate and/or biphosphates at a temperature and under conditions sufficient to form the corresponding ester of said alcohol.

10 Claims, 2 Drawing Sheets

PROCESS FOR TREATMENT OF PETROLEUM ACIDS

This application is a 371 of PCT/US00/12834, filed May 9, 2000, which is a continuation-in-part of 09/309,941, filed May 11, 1999, now U.S. Pat. No. 6,190,541.

FIELD OF THE INVENTION

The present invention relates to a process for reducing both the acidity and corrosivity of petroleum oils.

BACKGROUND OF THE INVENTION

Whole crudes and crude fractions with high organic acid content such as those containing carboxylic acids, specifically naphthenic acids, are corrosive to the equipment used to extract, transport and process the crudes. Solutions to this problem have included use of corrosion-resistant alloys for equipment, use of corrosion inhibitors, and neutralization of the organic acids with various bases.

Efforts to minimize organic acid corrosion have included a number of approaches by neutralizing and removing the acids from the oil. For example. U.S. Pat. No. 2,302,281 and Kalichevsky and Kobe in Petroleum Refining with Chemicals (1956), Chapter 4, disclose various base treatments of oils and crude fractions. U.S. Pat. No. 4,199,440 discloses treatment of a liquid hydrocarbon with a dilute aqueous alkaline solution, specifically dilute aqueous NaOH or KOH. U.S. Pat. No. 5,683,626 teaches treatments of acidic crudes with tetra-alkylammonium hydroxide and U.S. Pat. No. 5,643,439 uses trialkylsilanolates. PCT US96/13688, US/13689 and US/13690 (Publication WO 97/08270, 97/08271 and 97/08275 dated Mar. 6, 1997) teach the use of Group IA and Group IIA oxides and hydroxides to treat whole crudes and crude fractions to decrease naphthenic acid content. U.S. Pat. No. 4,300,995 discloses the treatment of carbonaceous material, particularly coal and its products, heavy oils, vacuum gas oil, and petroleum resids having acidic functionalities with a dilute quaternary base, such as tetramethylammonium hydroxide in a liquid (alcohol or water). This patent was aimed at improving yields and physical characteristics of the products and did not address the question of acidity reduction.

It is known that mineral acids catalyze nucleophilic additions (esterification) of carboxylic acids with alcohols. (See, for example, Streitwieser, Jr. and Heathcock, Introduction to Organic Chemistry, second edition, Chapter 18, page 516.) However, the addition of such mineral acids to esterify organic acids in petroleum oils would be counterproductive since acid would be added to the oil to achieve an acid reduction. One would merely be replacing one acid with another, more corrosive acid.

While the above processes have achieved varying degrees of success there is a continuing need to develop more efficient methods for treating acidic crudes, particularly by decreasing the amounts of treating compounds used. Applicants' invention addresses these needs.

SUMMARY OF THE INVENTION

Figure 1:
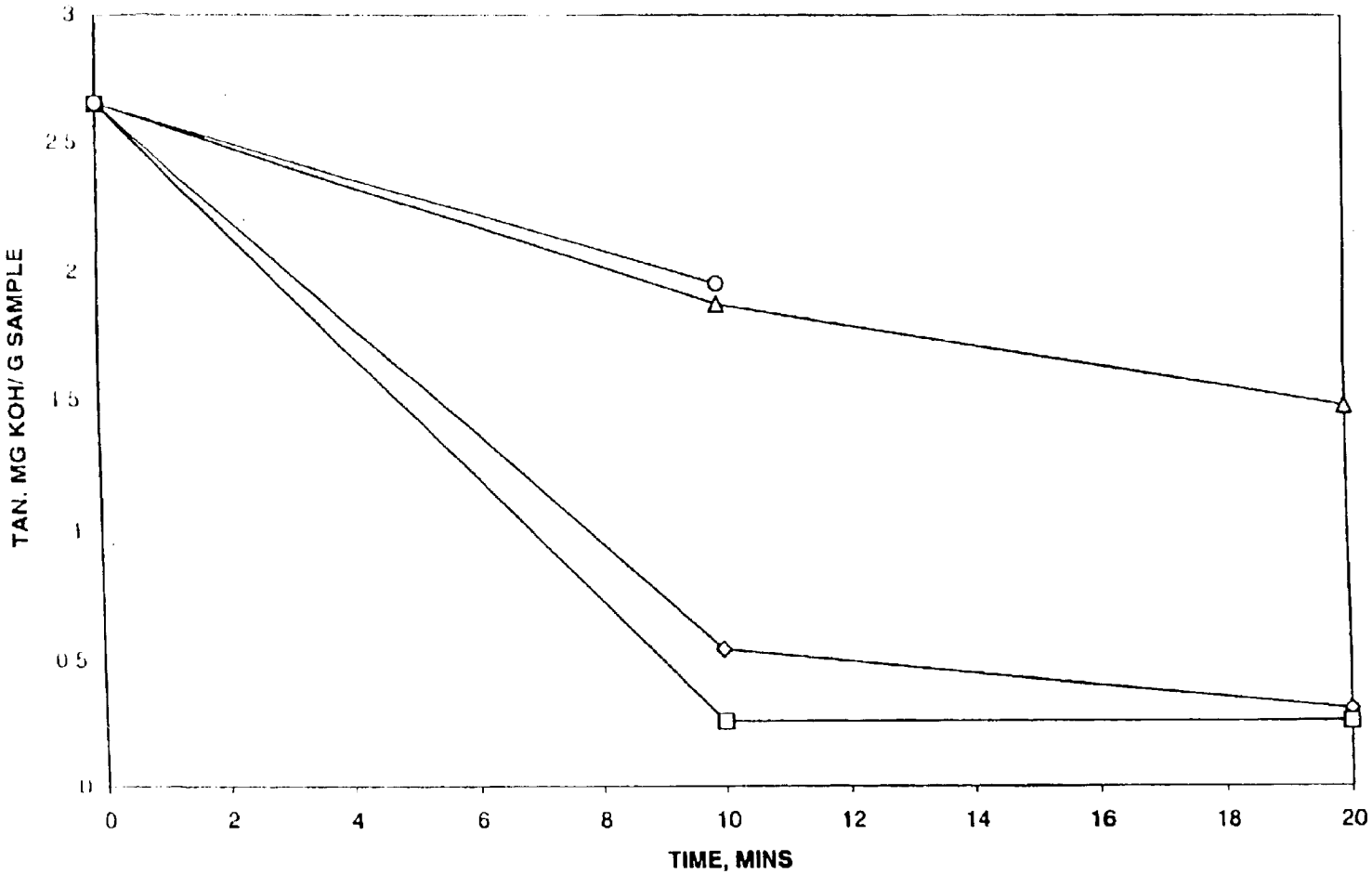
FIG. 1 is a plot of TAN (y-axis) vs. time of esterification with methanol at 350° C. (x-axis): diamonds indicate 14 ppm Na. squares indicate 70 ppm Na. triangles indicate 286 ppm Na and circles indicate methanol only.

The present invention relates in one embodiment to a process for decreasing the acidity and optionally the corrosivity of an organic acid containing petroleum stream, comprising contacting said organic acid containing petroleum stream with an effective amount of $C_1$ to about $C_{13}$ alkanol or alkane diol in the presence of trace amounts of a base selected from a Group IA metal phosphate, biphosphate carbonate or hydroxide at a temperature and under conditions sufficient to form the corresponding ester of said alcohol. In another embodiment the dual benefit of acidity and corrosivity decrease may be achieved when the contacting is carried out in the presence of the petroleum stream, alcohol, trace amounts of a Group IA metal hydroxide and at least one of a Group IA metal phosphate or biphosphate.

The present invention may suitably comprise, consist or consist essentially of the elements disclosed and may be practiced in the absence of an element not disclosed.

DETAILED DESCRIPTION OF THE INVENTION

Some petroleum streams and oils contain organic acids that contribute to corrosion or fouling of refinery equipment and that are difficult to separate from the processed oil. The organic acids generally fall within the category of naphthenic and other organic acids. Naphthenic acid is a generic term used to identify a mixture of organic carboxylic acids present in petroleum stocks. Naphthenic acids may be present either alone or in combination with other organic acids, such as phenols. Naphthenic acids alone or in combination with other organic acids can cause corrosion at temperatures ranging from about 65° C. (150° F.) to 420° C. (790° F.). Reduction of the naphthenic acid content of such petroleum oils is a goal of the refiner.

The petroleum oils that may be treated in accordance with the instant invention are any organic acid-containing petroleum stream including whole crude oils and crude oil fractions that are liquid, liquifiable or vaporizable at the temperatures at which the present invention is carried out. As used herein the term whole crudes means unrefined, non-distilled crudes. The petroleum oils are preferably whole crudes.

Unexpectedly, Applicants have discovered that petroleum oils containing organic, particularly naphthenic acids, may have their naphthenic acid content reduced by treatment with an effective amount of alcohol in the presence of an effective amount of a Group IA metal hydroxide, carbonate, phosphate or biphosphate, or a combination of Group IA metal phosphate and/or biphosphate and Group IA metal hydroxide. The treatment is conducted under conditions capable of converting the alcohol and acid to the corresponding ester. For example, if methanol is used, the naphthenic acid will be converted into its methyl ester. Treatment temperatures will preferably range from about ambient to below the cracking temperature of the petroleum oil, typically about 450° C. Pressures generally result from the system itself (autogenous pressure). Pressures of from about 100 (14 psi) to about 3000 kPa (430 psig) are typical. For example, the reaction at 350° C. may be carried out at about 1750 kPa (250 psig).

Optionally, at least a portion of the excess methanol may be recovered and reused in either a batch or continuous process to contact additional untreated petroleum oil. Such recovery is readily accomplished by the skilled artisan.

Desirably the esters produced from reaction of the acids and alcohols may be left in the treated petroleum oil without any detrimental effect.

The alcohols usable herein are preferably commercially available. The alcohols may be selected from alkanols and alkane diols. The alkanols are preferably those having $C_1$ to $C_{13}$ more preferably $C_1$ to $C_7$, most preferably $C_1$ to $C_5$ carbons and the alkane diols are preferably those having $C_2$ to $C_9$ more preferably $C_2$ to $C_6$ most preferably $C_2$ to $C_5$ carbons. Preferably, the alcohol will be methanol or ethanol, most preferably methanol. The alcohols usable need only be capable of forming a thermally and hydrolytically stable ester with the acids contained in the petroleum oil being treated. Choice of alcohols meeting the above criteria is easily accomplished by the skilled artisan. Use of higher alcohols may necessitate addition of a suitable non-interfering cosolvent which also may be selected by one skilled in the art. The hydrolytic stability is facilitated if the petroleum oil contains less than about 5 weight percent water, more preferably less than 3 weight percent water and most preferably less than one weight percent water.

The trace materials used in the treatment process are basic compounds selected from Group IA metal phosphates, biphosphates, carbonates and hydroxides when only acid level reduction is desired and from Group IA metal phosphates and/or biphosphates, in combination with hydroxides when both acidity and corrosivity reduction is desired. The Group IA metals are preferably K and Na, most preferably K. It is also possible to use Group IIA metals for the treatment, however, reactions with these tend to be less economically desirable because they are not as strongly basic and rates are not as fast.

The metals are added in effective trace amounts, typically up to a total of 300 wppm. more typically an effective amount of from about 50–300 wppm. When used in combination, about equal trace amounts of Group IA metal hydroxide and phosphate and/or biphosphate may be used. However, within this range the amount of hydroxide and phosphate can be chosen to balance the enhanced rate by using excess hydroxide or corrosion inhibition by using excess phosphate.

Unexpectedly, use of these trace amounts in combination with methanol in the treatment of organic acid-containing petroleum oils produces a decrease in acidity when the Group IA metal carbonates, hydroxides, phosphates or biphosphates are used alone, or acidity and corrosivity when Group IA phosphates and/or biphosphates, and hydroxides are used in combination that is significantly enhanced over the use of methanol alone. i.e., a several-fold rate increase in the process can be observed.

The enhancement using such trace amounts of base given the enhanced reaction rates that can be achieved using trace levels of the base is unexpected over treatments using larger quantities of base and also beneficially decreases the likelihood of emulsion formation.

The introduction of oxygen containing gas, although typically not of consequence to the reaction typically would be minimized in order to prevent air oxidation to form peroxides, which can initiate subsequent downstream fouling reactions in the refinery.

The faster rates can provide additional benefit in refinery processes by enabling the use of smaller reaction vessels and minimizing the need for recovery of remaining unreacted base; the low levels at which it is used provide essentially complete reaction in a shorter period of time.

Contacting times for the treatment depend on the nature of the petroleum oil beings treated and its acid content. Typically, contacting will be carried out from minutes to several hours. As noted previously, the contact time is that necessary to form an ester of the alcohol and acid.

The trace amounts utilized herein serve to accelerate the esterification of the alcohol and organic acids in the petroleum oil being treated. Likewise, there is no harm in accelerating the esterification in oils where the esterification would occur at an acceptable rate in the absence of the use of trace amounts of the bases as described herein.

The molar ratio of alcohol to organic acid in the petroleum oil can range from about 0.5 to about 20, preferably, about 1 to about 15.

The extent of esterification can be estimated by infrared spectroscopy, which shows a decrease in intensity of the 1708 $cm^{-1}$ band, attributed to carboxylic groups. A new band appears at 1742 $cm^{-1}$, attributed to ester groups. In some cases, naphthenic acids are partly converted to ketones, which give a band around 1715 $cm^{-1}$. To distinguish between a ketone and a carboxyl band, the sample is treated with triethylamine, which eliminates the carboxyl band and leaves the ketone band unchanged.

The concentration of acid in the crude oil is typically expressed as an acid neutralization number or acid number, which is the number of milligrams of KOH required to neutralize the acidity of one gram of oil. It may be determined by titration according to ASTM D-664. Any acidic petroleum oil may be treated according to the present invention, for example, oils having an acid neutralization number of from 0.5 to 10 mg KOH/g acid. Typically, the decrease in acid content may be determined by a decrease in the neutralization number or in the intensity of the carboxyl band in the infrared spectrum at about 1708 $cm^{-1}$. Petroleum oils with acid numbers of about 1.0 and lower are considered to be of moderate to low corrosivity. Petroleum oils with acid numbers greater than 1.5 are considered corrosive. Acidic petroleum oils having free carboxyl groups may be effectively treated using the process of the present invention.

FIG. 1 demonstrates that low levels of sodium (as NaOH) dissolved in methanol enhance the rate of esterification in the process.

Figure 2:
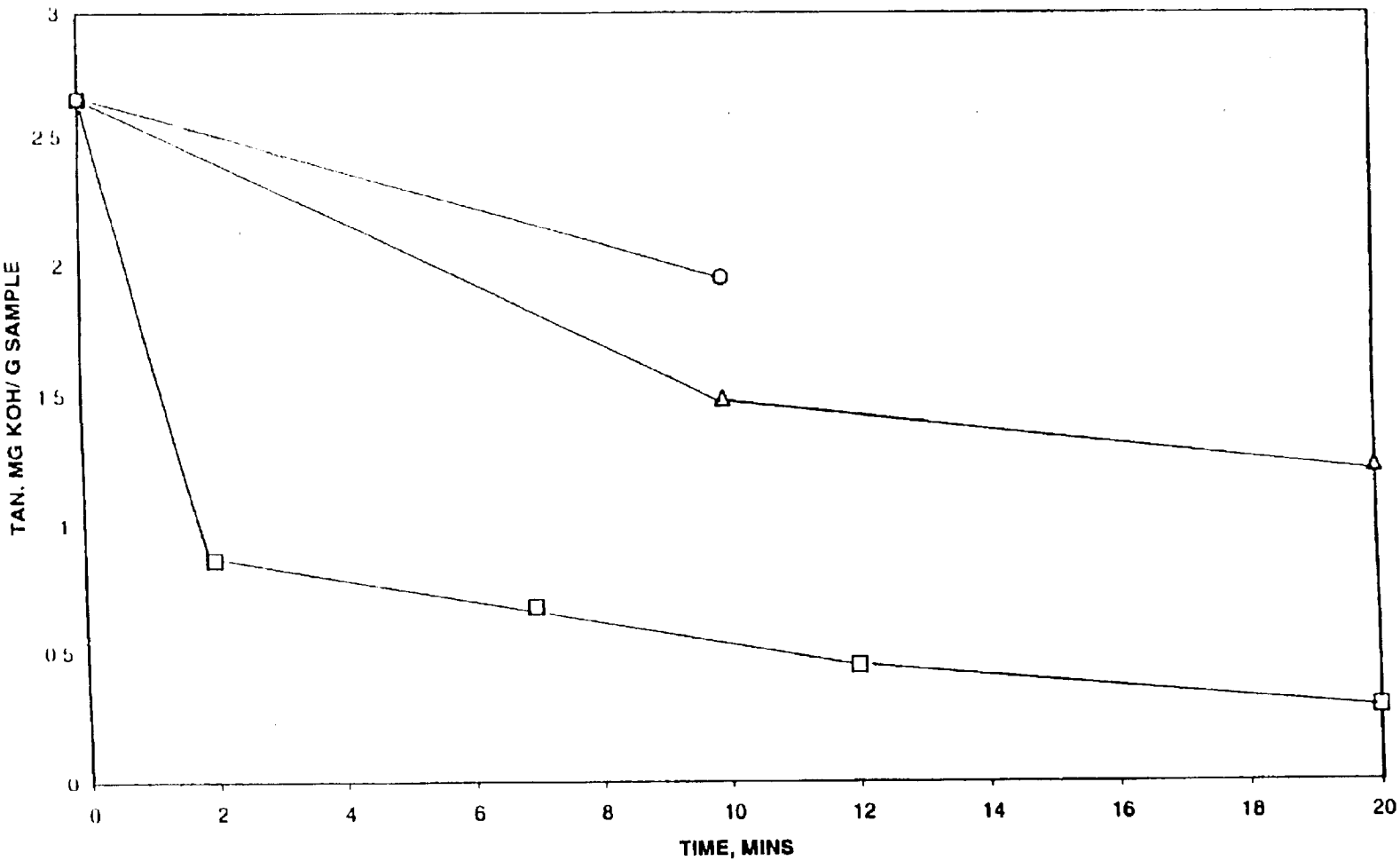
FIG. 2 is a plot of TAN (y-axis) vs. time (x-axis): triangles indicate 250 ppm K as $K_3PO_4$, squares indicate 125 ppm K as KOH plus 125 ppm K as $K_3PO_4$ and circles indicate methanol only.

FIG. 2 shows the catalytic esterification with methanol and low potassium (as $K_3PO_4$ and/or KOH) levels at 350° C. on a Heidrun crude according to the process of the present invention.

Petroleum oils are very complex mixtures containing a wide range of contaminants and in which a large number of competing reactions may occur. Thus, the reactivity of particular compounds to produce the desired neutralization is not predictable. The simplicity of the process makes it highly desirable.

The present invention may be demonstrated with reference to the following non-limiting examples.

EXAMPLE 1

A Heidrun crude oil (120 g) was charged into a 300 mL autoclave reactor followed by addition of 0.37 g of a 16.15 wt % sodium hydroxide solution in methanol to give a final concentration of 286 wppm of sodium in the crude and an additional 1.4 g of methanol so the total methanol is equivalent to a tenfold stoichiometric amount of all the acids in the Heidrun crude oil. The reactor was then closed, mixing started at 400 rpm and the contents heated to 350° C. The entire reaction sequence takes place in one reactor. Typically 5–10 mL samples were taken at different time intervals. e.g., after 2, 5, 10, 20, 40 and 60 min at 350° C. and the samples were analyzed for TAN (Total Acid Number).

The data in FIG. 1 illustrate that this reaction was essentially complete in 10 min with a TAN level of 0.25, whereas the uncatalyzed reaction and reaction with 14 wppm of sodium require over an hour to achieve TAN reduction of 0.5. Increasing the sodium concentration to 858 wppm gave no added benefit. At 70 wppm of sodium a TAN level of 0.5 was reached in about 10 minutes versus the uncatalyzed case which required an hour to reach this level. The cost, ash level tolerable, and level of TAN desired will dictate the catalytic level chosen, e.g., 70 or 286 wppm levels.

EXAMPLE 2

The procedure of Example 1 was followed except that potassium phosphate (250 wppm of potassium) was used in place of the sodium hydroxide. The results (FIG. 2) showed that the potassium phosphate rate and level of TAN reduction was greater than the methanol only case. However, use of the phosphate salt, which is basic, results in formation of traces of phosphoric acid which is desirable to passivate the metal surface of the carbon steel reactor.

EXAMPLE 3

The procedure of Example 1 was followed except that a 50:50 wt % mixture of potassium hydroxide and potassium phosphate (total potassium level of 250 wppm) was used. This treatment achieve comparable rates and TAN levels to the 286 wppm level of sodium in Example 1 while simultaneously inhibiting corrosion.

What is claimed is:

1. A process for decreasing the acidity of an organic acid-containing petroleum oil, comprising containing said petroleum oil containing organic acids with an effective amount of an alcohol and an effective trace amount of up to 300 wppm of a base selected from group IA and IIA metal carbonates, hydroxides, phosphates, biphosphates and mixtures of a hydroxide and at least one of phosphates or biphosphates at a temperature and under conditions sufficient to form at the corresponding ester of said alcohol.

2. The process of claim 1 wherein the base is about a 50:50 wt % mixture of potassium hydroxide and at least one of potassium phosphate and potassium biphosphate.

3. The process of claim 1 wherein the process is carried out at a temperature ranging from about ambient to below the cracking temperature of the oil.

4. The process of claim 1 wherein said alcohol is selected from the group consisting of alkanols, alkane diols, and mixtures thereof.

5. The process of claim 4 wherein said alkanol is selected from $C_1$ to $C_{13}$ alkanols.

6. The process of claim 5 wherein said alkanol is methanol, ethanol and mixtures thereof.

7. The process of claim 6 wherein said alkanol is methanol.

8. The process of claim 4 wherein said alkane diols are $C_2$ to $C_{13}$ alkane diols.

9. The process of claim 1 wherein the molar ratio of alcohol to organic acid in the petroleum feed is about 0.5 to about 20.

10. The process of claim 1 wherein the Group IA metal is selected from K to Na and mixtures thereof.

* * * * *